US009019195B2

(12) United States Patent
Min et al.

(10) Patent No.: US 9,019,195 B2
(45) Date of Patent: Apr. 28, 2015

(54) APPARATUS AND METHOD FOR DRIVING BACKLIGHT USING SCANNING BACKLIGHT SCHEME, LIQUID CRYSTAL DISPLAY DEVICE AND ITS DRIVING METHOD USING SCANNING BACKLIGHT SCHEME

(75) Inventors: ByungSam Min, Yangju-si (KR); BoGun Seo, Paju-si (KR); YongWon Jo, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 163 days.

(21) Appl. No.: 13/532,521

(22) Filed: Jun. 25, 2012

(65) Prior Publication Data

US 2013/0021386 A1 Jan. 24, 2013

(30) Foreign Application Priority Data

Jul. 20, 2011 (KR) ..... 10-2011-0072146
May 2, 2012 (KR) ..... 10-2012-0046512

(51) Int. Cl.
*G09G 3/36* (2006.01)
*G09G 3/34* (2006.01)

(52) U.S. Cl.
CPC ... *G09G 3/34* (2013.01); *G09G 3/36* (2013.01)

(58) Field of Classification Search
USPC ..... 345/102, 690, 92
See application file for complete search history.

(56) References Cited

U.S. PATENT DOCUMENTS

| | | | | |
|---|---|---|---|---|
| 2005/0242756 | A1* | 11/2005 | Honbo | 315/403 |
| 2007/0152951 | A1 | 7/2007 | Ahn | |
| 2008/0018587 | A1 | 1/2008 | Honbo et al. | |
| 2008/0055230 | A1* | 3/2008 | Jang et al. | 345/102 |
| 2010/0053228 | A1* | 3/2010 | Yeo et al. | 345/690 |
| 2011/0249033 | A1* | 10/2011 | Oh et al. | 345/690 |

FOREIGN PATENT DOCUMENTS

| | | | |
|---|---|---|---|
| CN | 101029986 | A | 9/2007 |
| CN | 101369407 | A | 2/2009 |

* cited by examiner

*Primary Examiner* — Jonathan Blancha
(74) *Attorney, Agent, or Firm* — Birch, Stewart, Kolasch & Birch, LLP

(57) ABSTRACT

A backlight driving apparatus and method, and an LCD device using the same and a driving method thereof are discussed. The backlight driving apparatus includes a backlight unit, a backlight driver, and a backlight controller. The backlight unit includes a plurality of light sources irradiating light on a liquid crystal display panel which displays an image according to a response of liquid crystal. The backlight driver sequentially turns on the light sources in units of a frame, according to a backlight dimming signal having a duty-on period and a duty-off period. The backlight controller generates the backlight dimming signal having a frequency equal to or higher than a frequency of a frame sync signal for the liquid crystal display panel by analyzing the image, according to external duty-on information.

20 Claims, 7 Drawing Sheets

APPARATUS AND METHOD FOR DRIVING BACKLIGHT USING SCANNING BACKLIGHT SCHEME, LIQUID CRYSTAL DISPLAY DEVICE AND ITS DRIVING METHOD USING SCANNING BACKLIGHT SCHEME

CROSS-REFERENCE TO RELATED APPLICATIONS

This application claims the benefit of the priority Korean Patent Application No. 10-2011-0072146 filed on Jul. 20, 2011 and the Korean Patent Application No. 10-2012-0046512 filed on May 2, 2012, which are hereby incorporated by reference as if fully set forth herein.

BACKGROUND

1. Field of the Invention

The present invention relates to a backlight driving apparatus and a Liquid Crystal Display (LCD) device, and more particularly, to a backlight driving apparatus and method, and an LCD device using the same and a driving method thereof, which can reduce consumption power.

2. Discussion of the Related Art

Generally, due to a slow response time of liquid crystal, a motion blurring phenomenon that blurs the contour of an image is shown on a moving image displayed by an LCD device. To prevent the motion blurring phenomenon, LCD devices of the related art use a scanning backlight scheme that sequentially turns on a plurality of light sources, disposed at a rear surface of a liquid crystal display panel, according to a backlight dimming signal.

A related art LCD device using the scanning backlight scheme sequentially turns on a plurality of light sources during a duty-on period according to the frequency of a backlight dimming signal having a duty-on period and a duty-off period, and thus improves a time (i.e., a motion picture response time) taken while the contour of an image is blurred and then cleared again.

In the related art LCD device using the scanning backlight scheme, the frequency of the backlight dimming signal is set equally to that of a frame sync signal. The decrease in the frequency of the frame sync signal is required for reducing consumption power, in which case the frequency of the backlight dimming signal is also decreased. However, if the frequency of the backlight dimming signal is decreased, flicker is perceived due to the turn-on/off of backlights.

SUMMARY

Accordingly, the present invention is directed to provide an apparatus and method for driving backlight, and an LCD device using the same and a driving method thereof that substantially obviate one or more problems due to limitations and disadvantages of the related art.

An aspect of the present invention is directed to provide a backlight driving apparatus and method, and an LCD device using the same and a driving method thereof, which can minimize flicker due to a scanning backlight and enhance the quality of a moving image, even when decreasing the frequency of a frame sync signal for reducing consumption power.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a backlight driving apparatus including: a backlight unit including a plurality of light sources irradiating light on a liquid crystal display panel which displays an image according to a response of liquid crystal; a backlight driver sequentially turning on the light sources in units of a frame, according to a backlight dimming signal having a duty-on period and a duty-off period; and a backlight controller generating the backlight dimming signal having a frequency equal to or higher than a frequency of a frame sync signal for the liquid crystal display panel by analyzing the image, according to external duty-on information.

In another aspect of the present invention, there is provided an LCD device including: a liquid crystal display panel displaying an image in units of a frame; a timing controller analyzing input data in units of a frame to generate duty-on information of the image, and generating a timing control signal with a timing sync signal including a frame sync signal; a panel driver generating a gate signal and a data signal to supply the gate signal and the data signal to the liquid crystal display panel, according to the timing control signal; and a backlight driving apparatus irradiating light on the liquid crystal display panel, according to the duty-on information and the frame sync signal which are supplied from the timing controller, wherein the backlight driving apparatus includes: a backlight unit including a plurality of light sources irradiating light on a liquid crystal display panel which displays an image according to a response of liquid crystal; a backlight driver sequentially turning on the light sources in units of a frame, according to a backlight dimming signal having a duty-on period and a duty-off period; and a backlight controller generating the backlight dimming signal having a frequency equal to or higher than a frequency of a frame sync signal for the liquid crystal display panel by analyzing the image, according to external duty-on information.

In another aspect of the present invention, there is provided a driving method of a backlight driving apparatus, which includes a plurality of light sources which irradiate light on a liquid crystal display panel displaying an image according to a response of liquid crystal, including: generating a backlight dimming signal having a frequency equal to or higher than a frame sync signal for the liquid crystal display panel according to external duty-on information according to the image; and sequentially turning on the light sources during the duty-on period in units of a frame, according to the backlight dimming signal.

In another aspect of the present invention, there is provided a driving method of an LCD device, which displays an image in units of a frame, including: analyzing input data in units of a frame to generate duty-on information of the image, and generating a timing control signal with a timing sync signal including a frame sync signal; generating a gate signal and a data signal to supply the gate signal and the data signal to the liquid crystal display panel, according to the timing control signal; and irradiating light on the liquid crystal display panel, according to the duty-on information and the frame sync signal, wherein the irradiating of light includes driving a backlight, the driving of a backlight including: generating a backlight dimming signal having a frequency equal to or higher than a frame sync signal for the liquid crystal display panel according to external duty-on information according to the image; and sequentially turning on the light sources during the duty-on period in units of a frame, according to the backlight dimming signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, preferable embodiments of the present invention will be described in detail with reference to the accompanying drawings.

Figure 1:
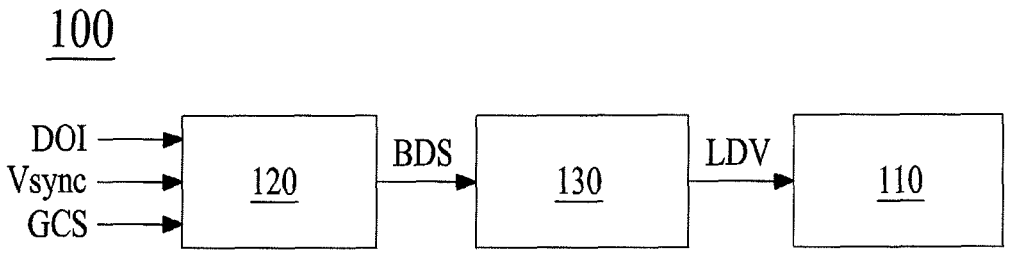
FIG. 1 is a diagram for describing a backlight driving apparatus according to an embodiment of the present invention.

FIG. 1 is a diagram for describing a backlight driving apparatus according to an embodiment of the present invention.

Referring to FIG. 1, a backlight driving apparatus 100 according to an embodiment of the present invention includes: a backlight unit 110 that includes a plurality of light sources (not shown); a backlight controller 120 that generates a backlight dimming signal BDS; and a backlight driver 130 that sequentially turns on the light sources in units of a frame according to the backlight dimming signal BDS supplied from the backlight controller 120.

The liquid crystal display panel is divided into a plurality of areas, and the backlight unit 110 includes the plurality of light sources that are respectively disposed in correspondence with the divided areas. Cold Cathode Fluorescent Lamps (CCFLs) or Light Emitting Diodes (LEDs) may be used as the light sources.

The light sources configured with LEDs may be driven by a serial scheme or a parallel scheme.

The backlight unit 110 may further include: a light guide panel (not shown) that guides light, irradiated from the light sources, to the liquid crystal display panel; a reflective sheet (not shown) that is disposed under the light guide panel and reflects incident light to the liquid crystal display panel; and a plurality of optical sheets (not shown) that are disposed on the light guide panel and enhance the luminance characteristic of light.

The backlight controller 120 generates the backlight dimming signal BDS which has a frequency equal to or higher than that of the frame sync signal Vsync and a duty-on period corresponding to the duty-on information DOI, according to the duty-on information DOI, the frame sync signal Vsync, and a gate control signal GCS that are supplied from the outside. Herein, the duty-on information DOI may be generated according to luminance of an image that is analyzed in units of a frame by a timing controller (not shown) or data analyzer (not shown) of an LCD device. For example, the duty-on information DOI may be generated according to an optimal power control scheme that controls the contour (or boundary portion) of an image more clearly.

The optimal power control scheme is technology that sets duty-on information DOI lower than duty-on information DOI based on luminance of an original image to decrease the luminance of the backlight unit 110 and increases the decreased luminance to the luminance of the original image by compensating for data in proportion to the decreased luminance of the backlight unit 110, thereby reducing the consumption power of the backlight unit 110.

The backlight driver 130 generates a light driving voltage LDV including a light-on voltage and a light-off voltage to sequentially turn on the light sources during the duty-on period, according to the backlight dimming signal BDS from the backlight controller 120.

The backlight driving apparatus 100 sets the frequency of the backlight dimming signal BDS equally to or higher than that of the frame sync signal Vsync according to the duty-on information DOI, and thus can minimize flicker due to the backlight dimming signal BDS.

Figure 2A:
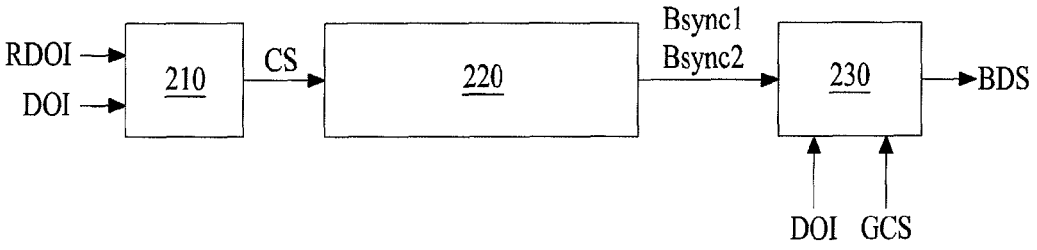
FIG. 2A is a diagram for describing a first embodiment of a backlight controller of FIG. 1.
Figure 2B:
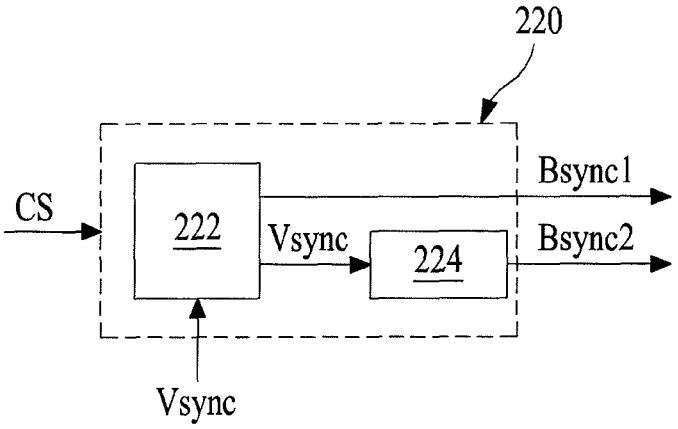
FIG. 2B is a diagram for describing a first embodiment of a backlight sync signal generation unit of FIG. 2A.

FIG. 2A is a diagram for describing a first embodiment of the backlight controller of FIG. 1. FIG. 2B is a diagram for describing a first embodiment of a backlight sync signal generation unit of FIG. 2A.

Referring to FIGS. 2A and 2B, the backlight controller 120 according to the first embodiment generates the backlight dimming signal BDS which has a first frequency equal to that of the frame sync signal Vsync or a second frequency (higher than the frequency of the frame sync signal Vsync) that is generated by multiplying the frequency of the frame sync signal Vsync by at least two times as an example, according to the duty-on information DOI. For example, the frequency of the frame sync signal Vsync may be about 60 Hz, and the second frequency may be about 120 Hz or about 180 Hz. For this end, the backlight controller 120 includes a comparison unit 210, a backlight sync signal generation unit 220, and a dimming signal generation unit 230.

The comparison unit 210 compares the size of the duty-on information DOI of a current frame with the size of predetermined reference duty-on information RDOI to generate a comparison signal CS having a first value or a comparison signal CS having a second value, and thus determines whether to change the frequency of the backlight dimming signal BDS.

The comparison unit 210 generates the comparison signal CS having the first value when the size of the duty-on information DOI of a current frame is less than that of the reference duty-on information RDOI. On the contrary, when the size of the duty-on information DOI of the current frame is equal to or greater than that of the reference duty-on information RDOI, the comparison unit 210 generates the comparison signal CS having the second value.

The reference duty-on information RDOI is set as a value corresponding to a duty-on period within a range from 25% to 35% during one frame. The reference duty-on information RDOI is a value that has been set by performing an experiment on whether the flicker of an image is caused by the duty-on period. For example, an experiment on flicker was conducted where an 8-bit full white image was displayed on the liquid crystal display panel and the duty-on period ratio of the backlight dimming signal BDS having a frequency of about 60 Hz was increased by 1% to 99%, and in the experiment result, flicker was not perceived in luminance of about 17 nit or less, but flicker was perceived in luminance of about 17 nit or more. According to the experiment, flicker due to luminance in the duty-on period is not perceived when luminance is low, but is perceived when luminance is high. The luminance of about 17 nit corresponds to a duty-on period within a range from 25% to 35%.

When the comparison signal CS having the first value is supplied from the comparison unit 210, the backlight sync signal generation unit 220 outputs the frame sync signal Vsync as-is to supply a first backlight sync signal Bsync1, having the first frequency equal to that of the frame sync signal Vsync, to the dimming signal generation unit 230. When the comparison signal CS having the second value is supplied from the comparison unit 210, the backlight sync signal generation unit 220 supplies a second backlight sync signal Bsync2 having the second frequency higher than that of the frame sync signal Vsync to the dimming signal generation unit 230. For this end, the backlight sync signal generation unit 220 includes a selection output unit 222 and a frequency generation unit 224.

The selection output unit 222 generates the first backlight sync signal Bsync1 having the first frequency equal to that of the frame sync signal Vsync and supplies the first backlight sync signal Bsync1 to the dimming signal generation unit 230, according to the comparison signal CS having the first value. However, the selection output unit 222 supplies the frame sync signal Vsync to the frequency generation unit 224 according to the comparison signal CS having the second value. The selection output unit 222 may be a demultiplexer.

The frequency generation unit 224 multiplies the frame sync signal Vsync supplied from the selection output unit 222 to generate the second backlight sync signal Bsync2 having the second frequency (for example, 90 Hz, 120 Hz, or 180 Hz) higher than that of the frame sync signal Vsync, and supplies the second backlight sync signal Bsync2 to the dimming signal generation unit 230.

Figure 3A:
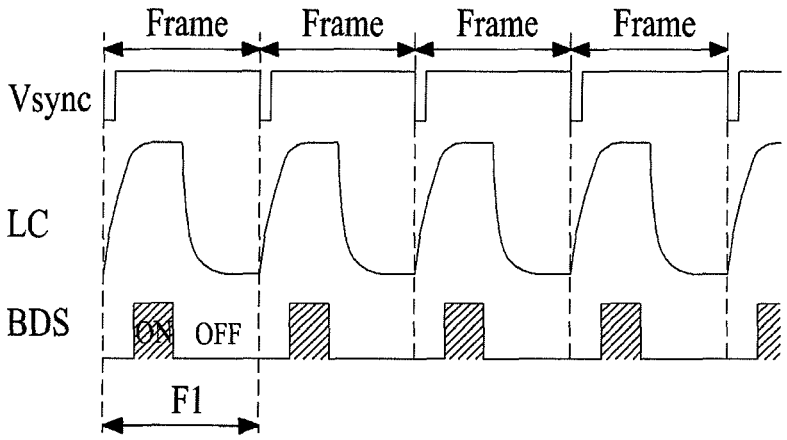
FIGS. 3A and 3B are diagrams for describing a backlight dimming signal according to a first embodiment of the present invention.
Figure 3B:
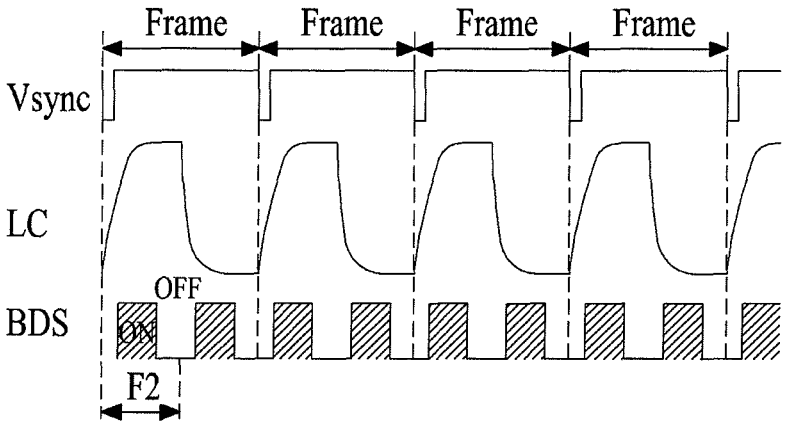

The dimming signal generation unit 230 generates the backlight dimming signal BDS that has the duty-on period ON corresponding to the duty-on information DOI and the duty-off period OFF other than the duty-on period ON and is synchronized with the gate control signal GCS, according to the first or second backlight sync signal Bsync1 or Bsync2 supplied from the backlight sync signal generation unit 220, and supplies the backlight dimming signal BDS to the backlight driver 130. For example, when the first backlight sync signal Bsync1 is supplied from the backlight sync signal generation unit 220, as shown in FIG. 3A, the dimming signal generation unit 230 generates the backlight dimming signal BDS having the first frequency F1 synchronized with each frame for the frame sync signal Vsync, and supplies the backlight dimming signal BDS to the backlight driver 130. However, when the second backlight sync signal Bsync2 is supplied from the backlight sync signal generation unit 220, as shown in FIG. 3B, the dimming signal generation unit 230 generates the backlight dimming signal BDS having the second frequency F2 synchronized with each frame of the frame sync signal Vsync, and supplies the backlight dimming signal BDS to the backlight driver 130.

The dimming signal generation unit 230 may include a delay unit (not shown) that delays the backlight dimming signal BDS by a delay time. The delay unit delays the duty-on period ON of the backlight dimming signal BDS having the first or second frequency F1 or F2, according to the delay time that has been set to be synchronized with a response time of liquid crystal based on the frequency of the frame sync signal Vsync.

The backlight controller 120 sets the frequency of the backlight dimming signal BDS equally to or higher than that of the frame sync signal Vsync according to the duty-on information DOI, and thus can minimize flicker due to the frequency of the backlight dimming signal BDS.

Figure 4:
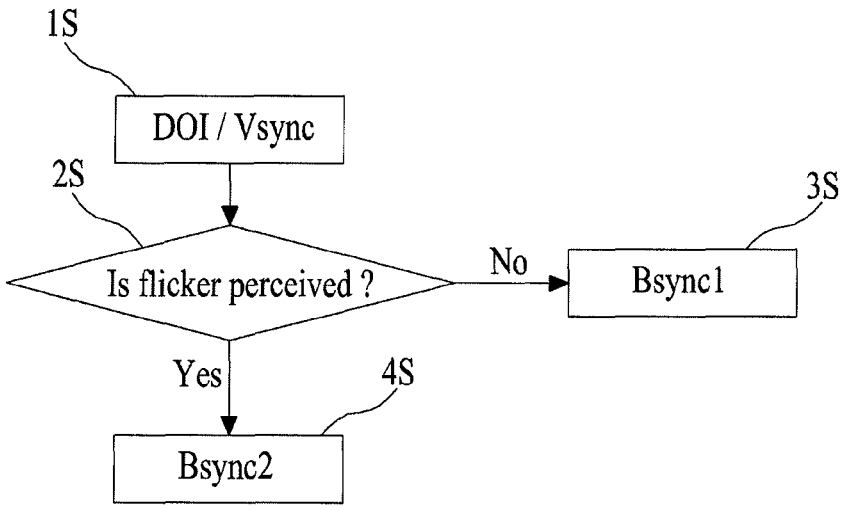
FIG. 4 is a flowchart for describing an operation of a backlight controller according to FIGS. 2A and 2B.

FIG. 4 is a flowchart for describing an operation of the backlight controller according to FIGS. 2A and 2B.

As seen in FIG. 4, when the duty-on information DOI and the frame sync signal Vsync are supplied in operation 1S, the backlight controller determines whether flicker is perceived according to the duty-on information DOI in operation 2S. Whether the flicker is perceived is determined by the above-described comparison unit 210.

When the flicker is not perceived (No), the backlight controller outputs the frame sync signal Vsync as-is to generate a first backlight sync signal Bsync1 having a first frequency equal to that of the frame sync signal Vsync in operation 3S.

When the flicker is perceived (Yes), the backlight controller generates a second backlight sync signal Bsync2 having a second frequency higher than that of the frame sync signal Vsync in operation 4S, thus preventing flicker due to the backlight dimming signal BDS.

Figure 5A:
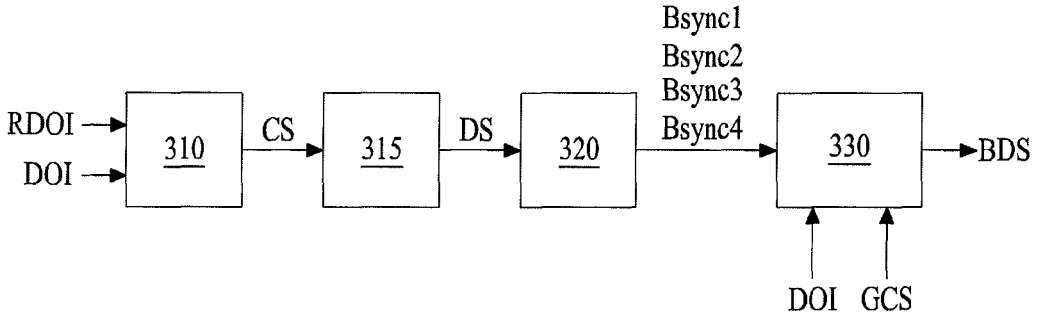
FIG. 5A is a diagram for describing a second embodiment of the backlight controller of FIG. 1.
Figure 5B:
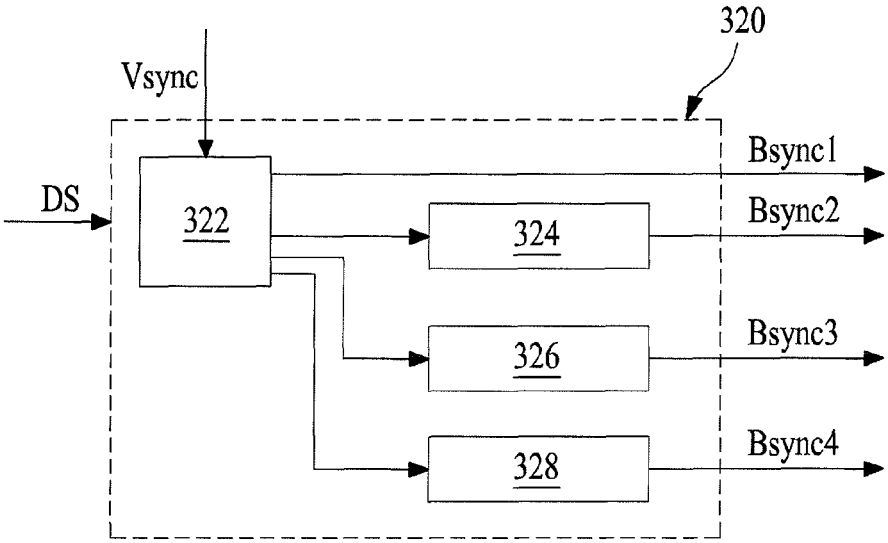
FIG. 5B is a diagram for describing a backlight sync signal generation unit of FIG. 5A.

FIG. 5A is a diagram for describing a second embodiment of the backlight controller of FIG. 1. FIG. 5B is a diagram for describing a backlight sync signal generation unit of FIG. 5A.

Referring to FIG. 1 and FIGS. 5A and 5B, a backlight controller 120 according to the second embodiment generates a backlight dimming signal BDS having the first frequency equal to that of the frame sync signal Vsync, a backlight dimming signal BDS having a second frequency (which is generated by multiplying the frequency of the frame sync signal Vsync) higher than that of the frame sync signal Vsync, a backlight dimming signal BDS that is gradually increased from the first frequency to the second frequency, or a backlight dimming signal BDS that is gradually decreased from the second frequency to the first frequency. For example, the frame sync signal Vsync may be 60 Hz, and the second frequency may be 90 Hz, 120 Hz, or 180 Hz. For this end, the backlight controller 120 according to the second embodiment includes a comparison unit 310, a frequency change determination unit 315, a backlight sync signal generation unit 320, and a dimming signal generation unit 330.

The comparison unit 310 compares the size of predetermined reference duty-on information RDOI with the size of duty-on information of a current frame to generate a comparison signal CS having a first value or a second value.

The comparison unit 310 generates the comparison signal CS having the first value when the duty-on information of the current frame is less than the reference duty-on information RDOI in size. On the contrary, when the duty-on information of the current frame is greater than the reference duty-on information RDOI in size, the comparison unit 310 generates the comparison signal CS having the second value.

In the reference duty-on information RDOI, as described above, the ratio of the duty-on period is set as a value of a range from 25% to 35% during one frame.

The frequency change determination unit 315 generates a frequency determination signal DS having each of first to fourth values, according to the comparison signal CS and frequency information of a previous frame. Herein, the frequency information of the previous frame may be frequency information of a backlight sync signal of a previous frame or frequency information of a backlight dimming signal.

When the comparison signal CS has the first value and the frequency (i.e., final frequency) of the previous frame is the first frequency equal to that of the frame sync signal Vsync, the frequency change determination unit 315 generates a frequency determination signal DS having the first value. On the contrary, when the comparison signal CS has the first value and the frequency (i.e., final frequency) of the previous frame is the second frequency higher than that of the frame sync signal Vsync, the frequency change determination unit 315 generates a frequency determination signal DS having the second value.

When the comparison signal CS has the second value and the frequency (i.e., final frequency) of the previous frame is the first frequency equal to that of the frame sync signal Vsync, the frequency change determination unit 315 generates a frequency determination signal DS having the third value. On the contrary, when the comparison signal CS has the second value and the frequency (i.e., final frequency) of the previous frame is the second frequency higher than that of the frame sync signal Vsync, the frequency change determination unit 315 generates a frequency determination signal DS having the fourth value.

When the frequency determination signal DS having the first value is supplied from the frequency change determination unit 315, the backlight sync signal generation unit 320 supplies the first backlight sync signal Bsync1 to the dimming signal generation unit 330 by using the frame sync signal Vsync.

When the frequency determination signal DS having the second value is supplied from the frequency change determination unit 315, the backlight sync signal generation unit 320 generates the second backlight sync signal Bsync2, which is gradually decreased from the second frequency to the first frequency, according to the frame sync signal Vsync and supplies the second backlight sync signal Bsync2 to the dimming signal generation unit 330.

When the frequency determination signal DS having the third value is supplied from the frequency change determination unit 315, the backlight sync signal generation unit 320 generates a third backlight sync signal Bsync3, which is gradually increased from the first frequency to the second frequency, according to the frame sync signal Vsync and supplies the third backlight sync signal Bsync3 to the dimming signal generation unit 330.

When the frequency determination signal DS having the fourth value is supplied from the frequency change determination unit 315, the backlight sync signal generation unit 320 generates a fourth backlight sync signal Bsync4 having the second frequency higher than that of the frame sync single Vsync according to the frame sync signal Vsync and supplies the fourth backlight sync signal Bsync4 to the dimming signal generation unit 330.

For this end, the backlight sync signal generation unit 320 includes a selection output unit 322, a step-down frequency generation unit 324, a step-up frequency generation unit 326, and a fixed frequency generation unit 328.

When the frequency determination signal DS having the first value is supplied from the frequency change determination unit 315, the selection output unit 322 supplies the first backlight sync signal Bsync1 to the dimming signal generation unit 330 by using the frame sync signal Vsync. On the contrary, when the frequency determination signal DS having the second value is supplied from the frequency change determination unit 315, the selection output unit 322 supplies the frame sync signal Vsync to the step-down frequency generation unit 324. Also, when the frequency determination signal DS having the third value is supplied from the frequency change determination unit 315, the selection output unit 322 supplies the frame sync signal Vsync to the step-up frequency generation unit 326. Also, when the frequency determination signal DS having the third value is supplied from the frequency change determination unit 315, the selection output unit 322 supplies the frame sync signal Vsync to the step-down frequency generation unit 328. Such a selection output 321 may be a demultiplexer.

The step-down frequency generation unit 324 generates a step-down frequency that is gradually decreased from the second frequency to the first frequency according to the frame sync signal Vsync supplied from the selection output unit 322, and supplies a second backlight sync signal Bsync2 having the generated step-down frequency to the dimming signal generation unit 330. Specifically, the step-down frequency generation unit 324 generates the second backlight sync signal Bsync2 having a step-down frequency corresponding to each step of a predetermined number of frequency steps. As an example, the step-down frequency generation unit 324 may generate a step-down frequency that is gradually decreased from 120 Hz to 100 Hz, 80 Hz, and 60 Hz, when the first frequency is 60 Hz, the second frequency is 120 Hz, and the number of frequency steps is 3.

The number of frequency steps may be set as N number (where N is a natural number more than 2) through an experiment. The number of frequency steps may be set to vary in real time according to the duty-on information DOI. In this case, the step-down frequency unit 324 may include a memory (not shown) and a detector (not shown).

The memory stores duty-on information DOI in units of a frame, and supplies the stored duty-on information DOI of a previous frame to the detector.

The detector detects an amount of changed duty-on information according to a difference value between duty-on information DOI of a current frame and duty-on information DOI of a previous frame supplied from the memory, and sets the number of frequency steps corresponding to the detected amount of changed duty-on information. When the amount of changed duty-on information is lower than a predetermined reference change amount, the detector sets the number of frequency steps as predetermined N number (where N is a natural number more than 2), or when the amount of changed duty-on information is equal to or higher than the reference change amount, the detector sets the number of frequency steps as predetermined M number (where M is a natural number different from N).

The step-up frequency generation unit 326 generates a step-up frequency that is gradually increased from the first frequency to the second frequency according to the frame sync signal Vsync supplied from the selection output unit 322, and supplies a third backlight sync signal Bsync3 having the generated step-up frequency to the dimming signal generation unit 330. Specifically, the step-up frequency generation unit 326 generates the third backlight sync signal Bsync3 having a step-down frequency corresponding to each step of a predetermined number of frequency steps. As an example, the step-up frequency generation unit 326 may generate a step-up frequency that is gradually increased from 60 Hz to 80 Hz, 100 Hz, and 120 Hz, when the first frequency is 60 Hz, the second frequency is 120 Hz, and the number of step-up frequencies is 3. The number of frequency steps, as described above, may be set as N number (where N is a natural number more than 2) through an experiment, or may be set to vary in real time according to the duty-on information DOI.

The fixed frequency generation unit 328 multiplies the frequency of the frame sync signal Vsync supplied from the selection output unit 322 to generate a fourth backlight sync signal Bsync4 having the second frequency (for example, 90 Hz, 120 Hz, or 180 Hz) higher than that of the frame sync signal Vsync, and supplies the fourth backlight sync signal Bsync4 to the dimming signal generation unit 330.

The dimming signal generation unit 330 generates the backlight dimming signal BDS that has the duty-on period ON corresponding to the duty-on information DOI and the duty-off period OFF other than the duty-on period ON and is synchronized with the gate control signal GCS, according to one of the first to fourth backlight sync signals Bsync1 to Bsync4 supplied from the backlight sync signal generation unit 320, and supplies the backlight dimming signal BDS to the backlight driver 130.

For example, when the first backlight sync signal Bsync1 is supplied from the backlight sync signal generation unit 320, as shown in FIG. 3A, the dimming signal generation unit 330 generates the backlight dimming signal BDS having the first frequency F1 equal to that of frame sync signal Vsync and supplies the backlight dimming signal BDS to the backlight driver 130, according to the first backlight sync signal Bsync1.

As another example, in the middle of outputting the backlight dimming signal BDS having the first frequency F1, when the fourth backlight sync signal Bsync4 is supplied from the backlight sync signal generation unit 320, as shown in FIG. 3B, the dimming signal generation unit 330 generates a backlight dimming signal BDS having the second frequency F2 and supplies the backlight dimming signal BDS to the backlight driver 130 according to the fourth backlight sync signal Bsync4.

Figure 6A:
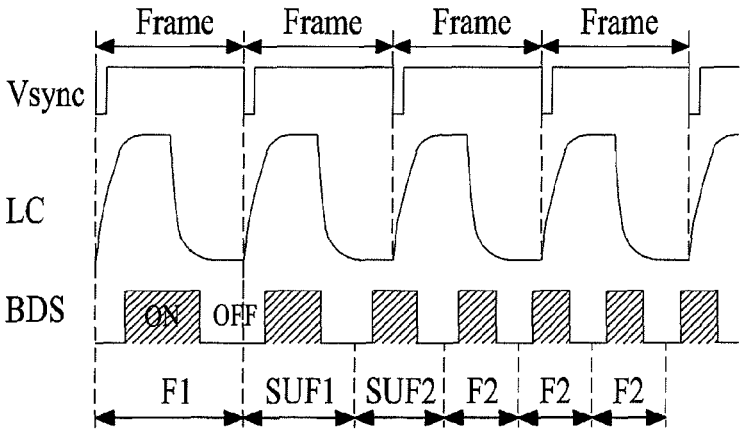
FIGS. 6A and 6B are diagrams for describing a backlight dimming signal according to a second embodiment of the present invention.

As another example, in the middle of outputting the backlight dimming signal BDS having the first frequency F1, when the third backlight sync signal Bsync3 is supplied from the backlight sync signal generation unit 320, as shown in FIG. 6A, the dimming signal generation unit 330 generates a backlight dimming signal BDS having a step-up frequency SUF1 or SUF2 that is gradually increased from the first frequency F1 to the second frequency F2 and supplies the backlight dimming signal BDS to the backlight driver 130 according to the third backlight sync signal Bsync3.

Figure 6B:
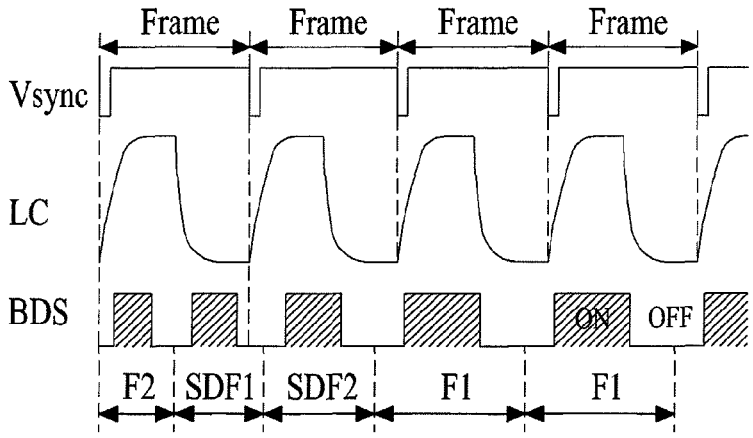

As another example, in the middle of outputting the backlight dimming signal BDS having the second frequency F2, when the second backlight sync signal Bsync2 is supplied from the backlight sync signal generation unit 320, as shown in FIG. 6B, the dimming signal generation unit 330 generates a backlight dimming signal BDS having a step-down frequency SDF1 or SDF2 that is gradually decreased from the second frequency F2 to the first frequency F1 and supplies the backlight dimming signal BDS to the backlight driver 130 according to the second backlight sync signal Bsync2.

The backlight controller 120 according to the second embodiment gradually increases or decreases the frame sync signal Vsync according to the duty-on information DOI when the change of the frequency of the backlight dimming signal BDS is required, thus preventing flicker due to the sudden change of the frequency of the backlight dimming signal BDS.

Figure 7:
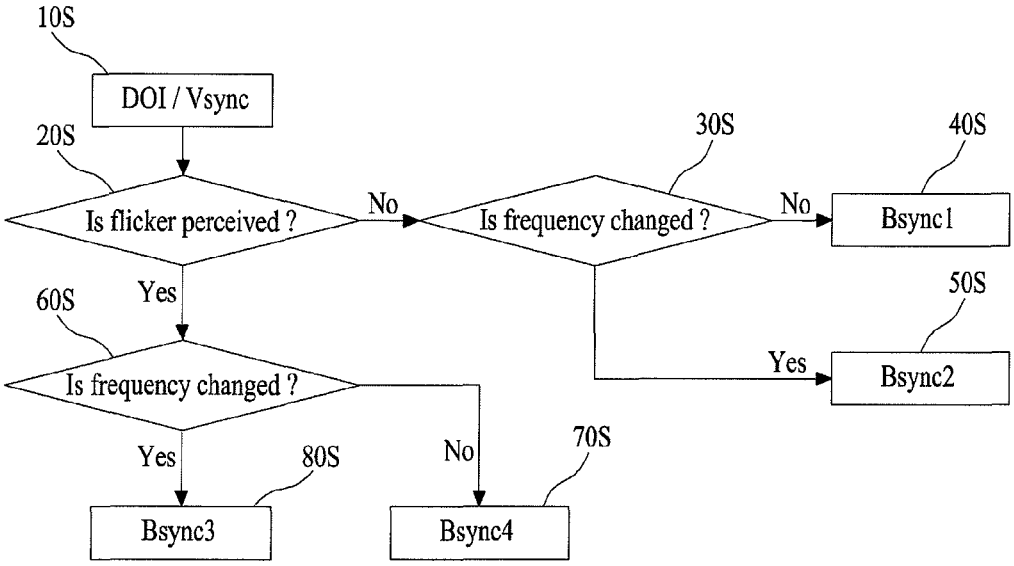
FIG. 7 is a flowchart for describing an operation of a backlight controller according to FIGS. 5A and 5B.

FIG. 7 is a flowchart for describing an operation of the backlight controller according to FIGS. 5A and 5B.

As seen in FIG. 7, when the duty-on information DOI and the frame sync signal Vsync are supplied from the outside in operation 10S, the backlight controller determines whether flicker is perceived according to the duty-on information DOI in operation 20S. Whether the flicker is perceived is determined by the above-described comparison unit 310.

When the flicker is not perceived (No) in the operation that determines whether the flicker is perceived, the backlight controller determines whether to change the frequency of the backlight sync signal in operation 30S. Whether to change the frequency of the backlight sync signal is determined by the above-described frequency change determination unit 315.

When the change of the frequency of the backlight sync signal is not required (No), the backlight controller outputs the frame sync signal Vsync as-is to generate the first backlight sync signal Bsync1 having the first frequency equal to that of the frame sync signal Vsync in operation 40S.

When the change of the frequency of the backlight sync signal is required (Yes), the backlight controller generates the second backlight sync signal Bsync2 having the step-down frequency that is gradually decreased from the second frequency F2 to the first frequency F1 in operation 50S, thus preventing flicker due to the sudden change of the frequency of the backlight sync signal.

When the flicker is perceived (Yes) in the operation that determines whether the flicker is perceived, the backlight controller determines whether to change the frequency of the backlight sync signal in operation 60S. Whether to change the frequency of the backlight sync signal is determined by the above-described frequency change determination unit 315.

When the change of the frequency of the backlight sync signal is not required (No), the backlight controller generates the fourth backlight sync signal Bsync4 having the second frequency higher than that of the frame sync signal Vsync in operation 70S, thus preventing flicker due to the backlight dimming signal BDS.

On the contrary, when the change of the frequency of the backlight sync signal is required (Yes), the backlight controller generates the third backlight sync signal Bsync3 having the step-up frequency that is gradually increased from the first frequency F1 to the second frequency F2 in operation 80S, thus preventing flicker due to the sudden change of the frequency of the backlight sync signal.

Figure 8:
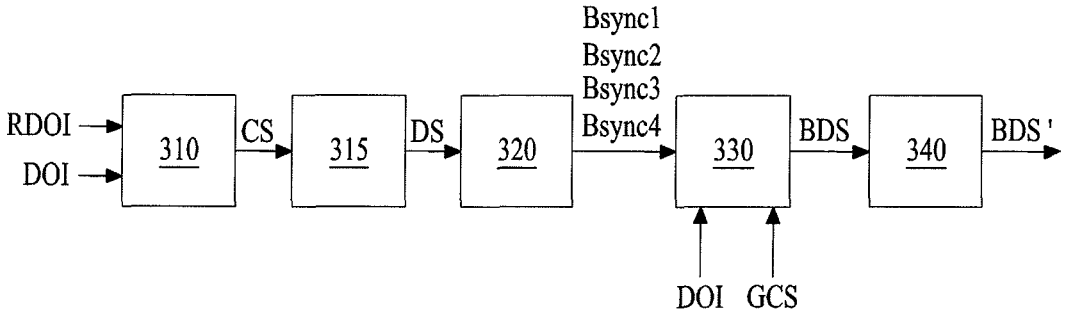
FIG. 8 is a diagram for describing a third embodiment of the backlight controller of FIG. 1.
Figure 9:
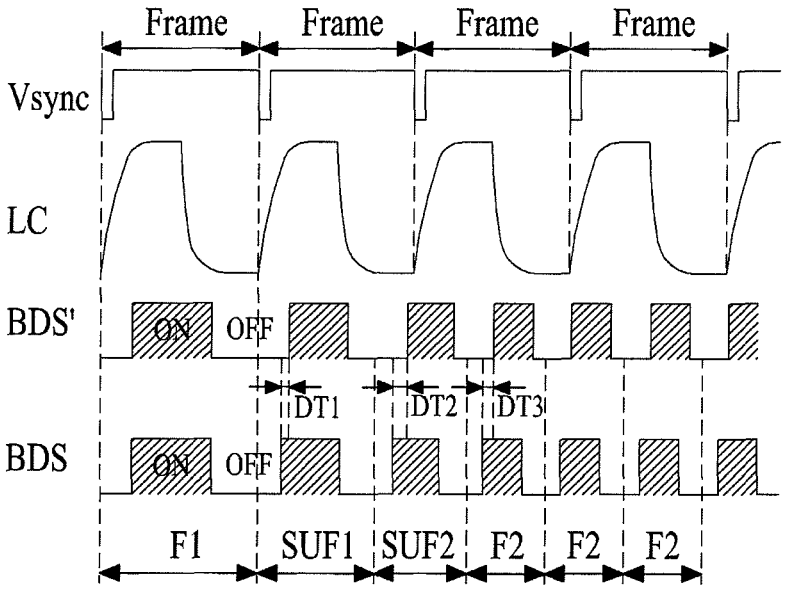
FIG. 9 is a waveform diagram for describing a dimming signal delay unit of FIG. 8.

FIG. 8 is a diagram for describing a third embodiment of the backlight controller of FIG. 1. FIG. 9 is a waveform diagram for describing the dimming signal delay unit of FIG. 8.

Referring to FIGS. 1, 8 and 9, a backlight controller 120 according to the third embodiment includes a comparison unit 310, a frequency change determination unit 315, a backlight sync signal generation unit 320, a dimming signal generation unit 330, and a dimming signal delay unit 340. Except for the dimming signal delay unit 340, the other elements of the backlight controller 120 according to the third embodiment are configured identically to the backlight controller 120 according to the second embodiment, and thus, their detailed descriptions are not provided. The descriptions of the second embodiment are applied to the other elements of the third embodiment, and like reference numerals refer to like elements.

The dimming signal delay unit 340 delays a duty-on period ON of the backlight dimming signal BDS supplied from the dimming signal generation unit 330 so as to be synchronized with a response time of liquid crystal, and thus supplies a delayed backlight dimming signal BDS' to the backlight driver 130. That is, the dimming signal delay unit 340 detects a rising edge of the duty-on period ON, and delays the detected rising edge for a certain time DT1, DT2 or DT3 to synchronize the rising edge with the response time of liquid crystal, thus improving a motion picture response time.

The backlight driver of FIG. 1 generates the light driving voltage LDV having a light-on voltage and a light-off voltage according to the delayed backlight dimming signal BDS' supplied from the dimming signal delay unit 340, and thus sequentially turns on a plurality of light sources for the duty-on period.

The backlight controller 120 according to the third embodiment provides the same effect as that of the backlight controller 120 according to the second embodiment. Moreover, the backlight controller 120 according to the third embodiment delays the duty-on period ON of the backlight dimming signal BDS that is gradually increased or decreased in frequency and thereby synchronizes the duty-on period ON of the backlight dimming signal BDS with the response time of liquid crystal, thus enhancing the quality of a moving image displayed on the liquid crystal display panel.

Figure 10:
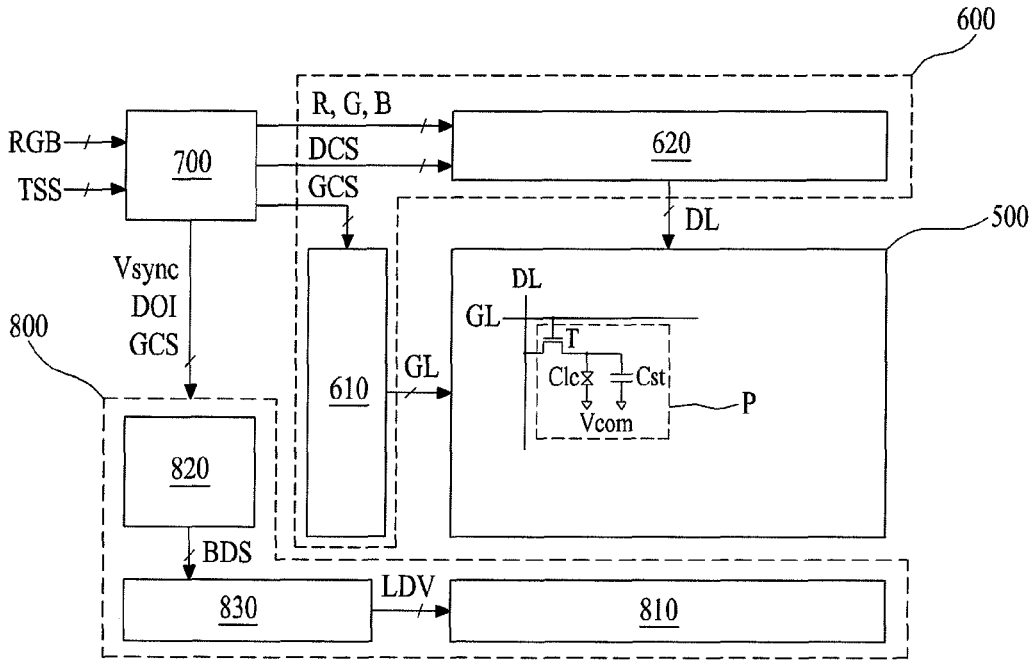
FIG. 10 is a diagram for describing an LCD device according to an embodiment of the present invention.

FIG. 10 is a diagram for describing an LCD device according to an embodiment of the present invention.

Referring to FIG. 10, an LCD device according to an embodiment of the present invention includes: a liquid crystal display panel 500 that displays an image in units of a frame; a timing controller 700 that analyzes input data RGB in units of a frame to generate duty-on information DOI of an image, and generates a data control signal DCS and a gate control signal GCS with a timing sync signal TSS including a frame sync signal Vsync; a panel driver 600 that generates a gate signal and a data signal and supplies the gate signal and the data signal to the liquid crystal display panel 500, according to the data control signal DCS and the gate control signal GCS; and a backlight driving apparatus 800 that irradiates light on the liquid crystal display panel 500 according to the scanning backlight scheme based on duty-on information DOI, the frame sync signal Vsync, and the gate control signal GCS which are supplied from the timing controller 600.

The liquid crystal display panel 500 displays an image through a pixel matrix where a plurality of pixels P are arranged. Each of the pixels P realizes a desired color by combining red (R) sub-pixel, green (G) sub-pixel, and blue (B) sub-pixel that adjust a light transmittance by varying the alignment of liquid crystal molecules according to a data signal. Each of the sub-pixels includes: a thin film transistor T that is connected to a gate line GL and a data line DL; a liquid crystal capacitor Clc that is connected to the thin film transistor T; and a storage capacitor that is connected to the thin film transistor T.

The liquid crystal capacitor Clc is charged with a difference voltage between a data signal (which is supplied to a pixel electrode (not shown) through the thin film transistor T) and a common voltage supplied to a common electrode (not shown), and drives liquid crystal molecules to adjust a light transmittance according to the charged voltage.

The storage capacitor Cst stably holds the charged voltage of the liquid crystal capacitor Clc until a data signal of a next frame is supplied thereto.

The panel driver 600 includes a gate driving circuit 610 that drives a plurality of gate lines GL formed in the liquid crystal display panel 500, and a data driving circuit 620 that drives a plurality of data lines DL formed in the liquid crystal display panel 500.

The gate driving circuit 610 generates a gate signal to sequentially supply the gate signal to the gate lines GL, according to the gate control signal GCS supplied from the timing controller 700. Herein, the gate driving circuit 610 may be formed on a substrate (not shown) simultaneously with when a plurality of thin film transistors are formed on the substrate, and built in the liquid crystal display panel 500.

The data driving circuit 620 latches digital data RGB supplied from the timing controller 700 according to the data control signal DCS supplied from the timing controller 700, converts the latched digital data into a positive/negative analog data voltage by using an analog positive/negative gamma voltage, and then generates a data voltage having a polarity corresponding to a polarity control signal POL to supply the data voltage to corresponding data lines DL in synchronization with the gate signal.

The timing controller 700 aligns external input data RGB to be suitable for driving of the liquid crystal display panel 500 and thus generates digital data RGB to supply the digital data RGB to the data driving circuit 620. Furthermore, the timing controller 700 generates the gate control signal GCS for controlling the driving timing of the gate driving circuit 610 and the data control signal DCS for controlling the driving timing of the data driving circuit 620 by using the timing sync signal TSS that includes a frame sync signal, a horizontal sync signal, a data enable signal, and a dot clock.

The timing controller 700 analyzes the input data RGB in units of a frame to generate duty-on information DOI corresponding to one frame image in units of a frame, and supplies the duty-on information DOI to the backlight driving apparatus 800. In this case, the timing controller 700 may generate the duty-on information DOI and correct respective grayscale values of the aligned digital data RGB according to the optimal power control scheme that controls the contour (or boundary portion) of an image more clearly.

The timing controller 700 may further include an overdriving circuit (not shown) that modulates the aligned digital data RGB of a current frame by using an overshoot value or an undershoot value based on differences between the aligned digital data RGB of the current frame and a previous frame, for enhancing the response time of liquid crystal.

The backlight driving apparatus 800 turns on a plurality of light sources (not shown) in units of a frame according to the scanning backlight scheme that is based on the duty-on information DOI, the frame sync signal Vsync, and the gate control signal GCS which are supplied from the timing controller 700, thereby irradiating light on the liquid crystal display panel 500 sequentially. For this end, the backlight driving apparatus 800 includes: a backlight unit 810 that includes the plurality of light sources (not shown); a backlight controller 820 that generates the backlight dimming signal BDS having a frequency equal to or higher than that of the frame sync signal Vsync according to the duty-on information DOI, frame sync signal Vsync, and gate control signal GCS which are supplied from the timing controller 700; and a backlight driver 830 that sequentially turns on the light sources in units of a frame according to the backlight dimming signal BDS supplied from the backlight controller 820.

The liquid crystal display panel 500 is divided into a plurality of areas, and the backlight unit 810 includes the plurality of light sources that are respectively disposed in correspondence with the divided areas. Cold Cathode Fluorescent Lamps (CCFLs) or Light Emitting Diodes (LEDs) may be used as the light sources.

The light sources configured with LEDs may be driven by a serial scheme or a parallel scheme.

The backlight unit 810 may further include: a light guide panel (not shown) that guides light, irradiated from the light sources, to the liquid crystal display panel 500; a reflective sheet (not shown) that is disposed under the light guide panel and reflects incident light to the liquid crystal display panel 500; and a plurality of optical sheets (not shown) that are disposed on the light guide panel and enhance the luminance characteristic of light.

The backlight controller 820 generates the backlight dimming signal BDS which has a frequency equal to or higher than that of the frame sync signal Vsync and a duty-on period corresponding to the duty-on information DOI, according to the duty-on information DOI, the frame sync signal Vsync, and the gate control signal GCS that are supplied from the timing controller 700. The backlight controller 820 has the same configuration as that of the backlight controller 120 according to one of the first to third embodiments that are illustrated in FIGS. 2A and 2B, FIGS. 5A and 5B, FIG. 4, or FIG. 8, and thus, its detailed description is not provided but the above description is applied to the backlight controller 820.

The backlight driver 830 generates the light driving voltage LVD having the light-on voltage and the light-off voltage to sequentially turn on the plurality of light sources according to the backlight dimming signal BDS supplied from the backlight controller 820.

As described above, the LCD device according to an embodiment of the present invention sets the frequency of the backlight dimming signal BDS equally to or higher than that of the frame sync signal Vsync according to the duty-on information DOI, and thus can minimize flicker due to the frequency of the backlight unit 810, reduce consumption power, and improve the quality of a moving image.

According to the embodiments of the present invention, the frequency of the backlight dimming signal is set equally to or higher than that of the frame sync signal according to the duty-on information, thus minimizing flicker due to the frequency of the backlight unit.

Moreover, the backlight dimming signal is generated to have the first frequency equal to that of the frame sync signal according to the duty-on information, or the backlight dimming signal is generated such that the frequency of the backlight dimming signal is gradually increased from the first frequency to the second frequency or is gradually decreased from the second frequency to the first frequency, thus minimizing flicker due to the frequency of the backlight unit and preventing flicker due to the sudden change of the frequency of the backlight dimming signal.

Moreover, the present invention delays the duty-on period of the backlight dimming signal that is generated to be gradually increased or decreased in frequency and thereby synchronizes the duty-on period of the backlight dimming signal having the first or second frequency with the response time of the liquid crystal according to the duty-on information, thus enhancing the quality of a moving image displayed on the liquid crystal display panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A backlight driving apparatus comprising:

a backlight unit comprising a plurality of light sources irradiating light on a liquid crystal display panel which displays an image according to a response of liquid crystal;

a backlight driver sequentially turning on the light sources in units of a frame, according to a backlight dimming signal having a duty-on period and a duty-off period; and a backlight controller generating the backlight dimming signal having a frequency equal to or higher than a frequency of a frame sync signal for the liquid crystal display panel, according to external duty-on information, wherein the backlight controller generates the backlight dimming signal having the frequency equal to the frequency of the frame sync signal for the liquid crystal display panel when the duty-on information is less than a predetermined reference duty-on information, and the backlight controller generates the backlight dimming signal having the frequency higher than the frequency of the frame sync signal for the liquid crystal display panel when the duty-on information is equal to or greater than the reference duty-on information.

2. The backlight driving apparatus of claim 1, wherein the backlight controller comprises:

a comparison unit comparing a size of the duty-on information with a size of the predetermined reference duty-on information to generate a comparison signal;

a backlight sync signal generation unit receiving the comparison signal from the comparison unit to generate a backlight sync signal; and a dimming signal generation unit generating the backlight dimming signal and supplying the backlight dimming signal to the backlight driver, according to the backlight sync signal from the backlight sync signal generation unit.

3. The backlight driving apparatus of claim 2, wherein, when the duty-on information is less than reference duty-on information, the comparison unit generates a comparison signal having a first value, and when the duty-on information is equal to or greater than the reference duty-on information, the comparison unit generates a comparison signal having a second value.

4. The backlight driving apparatus of claim 3, wherein, when the comparison signal having the first value is supplied from the comparison unit, the backlight sync signal generation unit generates a first backlight sync signal having a first frequency equal to the frame sync signal, and when the comparison signal having the second value is supplied from the comparison unit, the backlight sync signal generation unit generates a second backlight sync signal having a second frequency higher than the frame sync signal.

5. The backlight driving apparatus of claim 4, wherein the backlight sync signal generation unit comprises:

a selection output unit supplying the first backlight sync signal to the dimming signal generation unit by using the frame sync signal; and a frequency generation unit multiplying the frame sync signal supplied from the selection output unit to generate the second backlight sync signal, and supplying the second backlight sync signal to the dimming signal generation unit.

6. The backlight driving apparatus of claim 2, wherein the backlight controller further comprises a frequency change determination unit, the frequency change determination unit generating a frequency determination signal and supplying the frequency determination signal to the backlight sync signal generation unit according to the comparison signal and frequency information of a previous frame.

7. The backlight driving apparatus of claim 6, wherein, the comparison unit generates a comparison signal having a first value when the duty-on information is less than reference duty-on information, and generates a comparison signal having a second value when the duty-on information is equal to or greater than the reference duty-on information, and the frequency change determination unit generates a frequency determination signal having a first value when the comparison signal has the first value and a frequency of the previous frame is a first frequency equal to the frame sync signal, generates a frequency determination signal having a second value when the comparison signal has the first value and a frequency of the previous frame is a second frequency higher than the frame sync signal, generates a frequency determination signal having a third value when the comparison signal has the second value and a frequency of the previous frame is the first frequency equal to the frame sync signal, and generates a frequency determination signal having a fourth value when the comparison signal has the second value and a frequency of the previous frame is the second frequency higher than the frame sync signal.

8. The backlight driving apparatus of claim 7, wherein, when a frequency determination signal having the first value is supplied from the frequency change determination unit, the backlight sync signal generation unit generates a first backlight sync signal having a first frequency equal to the frame sync signal, when a frequency determination signal having the second value is supplied from the frequency change determination unit, the backlight sync signal generation unit generates a second backlight sync signal having a frequency which is gradually decreased from a second frequency to the first frequency, when a frequency determination signal having the third value is supplied from the frequency change determination unit, the backlight sync signal generation unit generates a third backlight sync signal having a frequency which is gradually increased from the first frequency to the second frequency, and when a frequency determination signal having the fourth value is supplied from the frequency change determination unit, the backlight sync signal generation unit generates a fourth backlight sync signal having the second frequency.

9. The backlight driving apparatus of claim 8, wherein the backlight sync signal generation unit comprises:

a selection output unit supplying the backlight sync signal to the dimming signal generation unit by using the frame sync signal according to the frequency determination signal having the first value;

a step-down frequency generation unit receiving the frame sync signal from the selection output unit to generate the second backlight sync signal;

a step-up frequency generation unit receiving the frame sync signal from the selection output unit to generate the third backlight sync signal; and a fixed frequency generation unit receiving the frame sync signal from the selection output unit to generate the fourth backlight sync signal.

10. The backlight driving apparatus of claim 9, wherein the step-down frequency generation unit further comprising a memory and a detector, the memory stores the duty-on information in units of the frame, and supplies the stored duty-on information of the previous frame to the detector.

11. The backlight driving apparatus of claim 2, wherein the backlight controller further comprising a dimming signal delay unit, the dimming signal delay unit delays the duty-on period of the backlight dimming signal to be synchronized with the response time of liquid crystal.

12. The backlight driving apparatus of claim 2, wherein the predetermined reference duty-on information is set as a value corresponding to the duty-on period within a range from 25% to 35% during one frame.

13. A Liquid Crystal Display (LCD) device comprising:

a liquid crystal display panel displaying an image in units of a frame;

a timing controller analyzing input data in units of a frame to generate duty-on information of the image, and generating a timing control signal with a timing sync signal comprising a frame sync signal;

a panel driver generating a gate signal and a data signal to supply the gate signal and the data signal to the liquid crystal display panel, according to the timing control signal; and a backlight driving apparatus irradiating light on the liquid crystal display panel, according to the duty-on information and the frame sync signal which are supplied from the timing controller, wherein the backlight driving apparatus comprises:

a backlight unit comprising a plurality of light sources irradiating light on a liquid crystal display panel which displays an image according to a response of liquid crystal;

a backlight driver sequentially turning on the light sources in units of a frame, according to a backlight dimming signal having a duty-on period and a duty-off period; and a backlight controller generating the backlight dimming signal having a frequency equal to or higher than a frequency of a frame sync signal for the liquid crystal display panel by analyzing the image, according to external duty-on information, wherein the backlight controller generates the backlight dimming signal having the frequency equal to the frequency of the frame sync signal for the liquid crystal display panel when the duty-on information is less than a predetermined reference duty-on information, and the backlight controller generates the backlight dimming signal having the frequency higher than the frequency of the frame sync signal for the liquid crystal display panel when the duty-on information is equal to or greater than the reference duty-on information.

14. A driving method of a backlight driving apparatus including a plurality of light sources which irradiate light on a liquid crystal display panel displaying an image according to a response of liquid crystal, the driving method comprising:

generating a backlight dimming signal having a frequency equal to or higher than a frame sync signal for the liquid crystal display panel according to external duty-on information according to the image; and sequentially turning on the light sources during the duty-on period in units of a frame, according to the backlight dimming signal, wherein the backlight dimming signal has the frequency equal to the frequency of the frame sync signal for the liquid crystal display panel when the duty-on information is less than a reference duty-on information, and the backlight dimming signal has the frequency higher than the frequency of the frame sync signal for the liquid crystal display panel when the duty-on information is equal to or greater than the reference duty-on information.

15. The driving method of claim 14, wherein the generating of a backlight dimming signal comprises:

generating a comparison signal having a first value when the duty-on information is less than reference duty-on information; and generating a comparison signal having a second value when the duty-on information is equal to or greater than the reference duty-on information.

16. The driving method of claim 15, wherein the generating of a backlight dimming signal comprises:

generating a first backlight sync signal having a first frequency equal to the frame sync signal when the comparison signal having the first value is generated; and generating a second backlight sync signal having a second frequency higher than the frame sync signal when the comparison signal having the second value is generated.

17. The driving method of claim 15, wherein the generating of a backlight dimming signal comprises:

generating a frequency determination signal having the first value when the comparison signal having the first value is generated and a frequency of the previous frame is a first frequency equal to the frame sync signal;

generating a frequency determination signal having the second value when the comparison signal having the first value is generated and a frequency of the previous frame is a second frequency higher than the frame sync signal;

generating a frequency determination signal having a third value when the comparison signal having the second value is generated and a frequency of the previous frame is the first frequency equal to the frame sync signal; and generating a frequency determination signal having a fourth value when the comparison signal having the second value is generated and a frequency of the previous frame is the second frequency higher than the frame sync signal.

18. The driving method of claim 17, wherein the generating of a backlight dimming signal comprises:

generating a first backlight sync signal having a first frequency equal to the frame sync signal, when a frequency determination signal having the first value is generated;

generating a second backlight sync signal having a frequency which is gradually decreased from a second frequency to the first frequency, when a frequency determination signal having the second value is generated;

generating a third backlight sync signal having a frequency which is gradually increased from the first frequency to the second frequency, when a frequency determination signal having the third value is generated; and generating a fourth backlight sync signal having the second frequency, when a frequency determination signal having the fourth value is generated.

19. The driving method of claim 14, further comprising delaying the duty-on period of the backlight dimming signal to be synchronized with the response time of liquid crystal.

20. A driving method of a Liquid Crystal Display (LCD) device which displays an image in units of a frame, the driving method comprising:

analyzing input data in units of a frame to generate duty-on information of the image, and generating a timing control signal with a timing sync signal comprising a frame sync signal;

generating a gate signal and a data signal to supply the gate signal and the data signal to the liquid crystal display panel, according to the timing control signal; and irradiating light on the liquid crystal display panel, according to the duty-on information and the frame sync signal, wherein the irradiating of light comprises driving a backlight, the driving of a backlight comprising:

generating a backlight dimming signal having a frequency equal to or higher than a frame sync signal for the liquid crystal display panel according to external duty-on information according to the image; and sequentially turning on the light sources during the duty-on period in units of a frame, according to the backlight dimming signal, wherein the backlight dimming signal has the frequency equal to the frequency of the frame sync signal for the liquid crystal display panel when the duty-on information is less than a reference duty-on information, and the backlight dimming signal has the frequency higher than the frequency of the frame sync signal for the liquid crystal display panel when the duty-on information is equal to or greater than the reference duty-on information.

* * * * *